US005532444A

United States Patent [19]

Bonrath et al.

[11] Patent Number: 5,532,444

[45] Date of Patent: Jul. 2, 1996

[54] PUSH BUTTON SWITCH

[75] Inventors: Herbert Bonrath, Bevern; Gerhard Hochgesang, Bad Neustadt; Ulrich Brüggemann, Heustreu; Hans-Karl Heil, Wildflecken, all of Germany

[73] Assignee: Preh-Werke GmbH & Co., KG, Bad Neustadt, Germany

[21] Appl. No.: 511,867

[22] Filed: Aug. 7, 1995

[30] Foreign Application Priority Data

Aug. 10, 1994 [DE] Germany ..... 44 28 285.0

[51] Int. Cl.[6] ..... H01H 3/42

[52] U.S. Cl. ..... 200/524.000; 200/447.000; 200/449.000

[58] Field of Search ..... 200/524, 525, 200/520, 528, 447, 449, 450, 457, 239, 530, 523

[56] References Cited

U.S. PATENT DOCUMENTS

| | | | |
|---|---|---|---|
| 4,086,455 | 4/1978 | Takahashi | 200/447 |
| 5,047,628 | 9/1991 | Schmidt et al. | 200/447 |
| 5,360,954 | 11/1994 | Brüggemann et al. | 200/524 |
| 5,426,274 | 6/1995 | Brüggemann et al. | 200/524 |

FOREIGN PATENT DOCUMENTS

| | | |
|---|---|---|
| 1590503 | 11/1970 | Germany . |
| 2031364 | 1/1972 | Germany . |
| 2839108 | 3/1980 | Germany . |
| 3150046A1 | 7/1983 | Germany . |
| 3644437C1 | 5/1988 | Germany . |
| 9101126 U | 6/1992 | Germany . |

*Primary Examiner*—David J. Walczak
*Attorney, Agent, or Firm*—Griffin, Butler, Whisenhunt & Kurtossy

[57] ABSTRACT

A push button switch, particularly a power supply switch, has contacts (4, 5) attached to a housing and a movable contact bridge (8) which is moved by means of a spring plunger (10'). A spring switching mechanism (26) transmits force between the spring plunger (10') and a manually-actuated switch actuator (22'). The switch actuator (22') is alternately latched and unlatched by a locking linkage (27, 28) which alternately holds the switch actuator in "switched-on" and "switched-off" positions when the switch actuator is repeatedly pushed. Additionally, a switching rocker (51) is provided between the switch actuator (22') and the spring plunger (10') to improve switching action. The switching rocker (51), at the beginning of "switching-on" and "switching-off" operations, forcibly carries the spring plunger (10') in its respective switching direction through a partial path of its contact stroke (H). Following this partial path the spring switching mechanism (26) moves the spring plunger (10') to its respective "switched-on" or "switched-off" position.

4 Claims, 8 Drawing Sheets

PUSH BUTTON SWITCH

BACKGROUND OF THE INVENTION

This invention relates to a push button switch, particularly a master, or power, switch, of a type having contacts attached to a housing and at least one movable contact bridge which is moved by a spring plunger, there being a spring switching mechanism transmitting force between the spring plunger and a manually-manipulated switch actuator, the push button switch also including a latching, or locking, linkage for the switch actuator for alternately locking the switch actuator in "on" and "off" positions.

Such switches are used for controlling power to electrical entertainment appliances, particularly television-type appliances.

German Patent Publication DE-AS 1 590 503 discloses such a push button switch. Experience has shown that such push button switches, despite their over-center spring switching mechanisms, can be undesirably manipulated by means of their switch actuators so that contact pressures are thereby influenced. When the switch actuators of such push button switches are not manipulated quickly enough, that is they are operated very slowly and/or only partially, it can happen, in spite of the over-center spring switching mechanism, that a contact pressure with which a contact bridge presses against housing-affixed contacts will go to zero and that this condition can be manually maintained. This causes an increase in contact resistance and, consequently, contact heating. Contact erosion is also coupled to this. Further, an overheated push button switch can result whose functioning ability as well as life span is not only decreased but which also presents a fire hazard.

A similar push button switch is disclosed in German Publication DE-GM 91 01 126. The system described herein is supposed to reduce contact bounce. However, this switch also has the above mentioned problems.

German Patent Publication DE 31 50 046 A1 discloses a push switch in which partially fused contacts are supposedly ripped apart by a separating mechanism. This system does not eliminate the above mentioned problems.

Another push button snapping switch is disclosed in German Patent Publication DE 28 39 108 A1. In this system a switch actuator must be pushed in opposite directions to turn the switch off and on. In the switch of German patent Publication DE 28 39 108 A1 arcing and contact bounce are supposedly reduced. To accomplish this a latching, or locking, apparatus is provided which blocks a spring plunger in its two end positions, with the spring plunger then being releasable by movement of a switch actuator. Also in this switch undesired manipulations are possible which cause the above mentioned problems to appear.

A further push button switch is disclosed in German Publication DE 20 31 364 A1. Also in this system the switch actuator is not latched alternately with each depression thereof between the "on" and "off" positions. In order to achieve a snapping action a member coupled to a snapping spring is shoved over a cam.

In German Patent Publication DE 36 44 437 C1 a push button switch is disclosed having a rocker arm and a rocker-arm engaging locking finger, which form locking linkage parts. One of the locking linkage parts is yieldably held by a spring in order to accommodate an overloading of its manipulation member in the manipulation direction.

A push button switch is described in German Patent Publication DE 43 01 192 C1 (U.S. Pat. No. 5,360,954) in which a manual manipulation leads to little increased erosion and operation dependability. A rubbing surface pair between a spring plunger and a housing mounted member, leads, shortly before a snapping of a spring switching mechanism caused by shoving a switch actuator, to an increased rubbing between the spring plunger and the housing mounted part whereby the snapping of the spring plunger is delayed.

The spring of the spring switching mechanism passes through its fully tensioned point when the switch actuator is moved. If the spring plunger begins to move it will be braked by the rubbing surface pair before the snapping point is reached so that a necessary contact pressure is maintained. The snapping point is, thereby, first reached at a greater spring tension than without this desired delay of movement of the spring plunger before the snapping; the spring plunger thereby passes through the snapping point also faster. In this manner, the snapping point, and therefore a contact pressure, can hardly be influenced by an improper manipulation of the switch actuator. The danger is also not present that the switch actuator can be manipulated and/or blocked in positions in which an increased contact transition resistance or electrical arcs lead to overheating, and thereby to increased erosion or fire hazards. A further rubbing surface pair between the spring plunger and a part affixed to the housing brakes movement of the spring plunger before impact of a contact bridge with housing-mounted contacts whereby bounce of the contacts is reduced.

It is an object of this invention to provide a push button switch that provides an improved switching operation, particularly when contact is made.

SUMMARY

According to principles of this invention a push button switch of a type described in the opening paragraph above has a switching rocker between a switch actuator and a spring plunger, with the switching rocker engaging on one side the switch actuator and on the other side the spring plunger and being mounted on the housing; the switching rocker, at the beginning of a switching operation of the spring plunger, forcibly carrying in a switching direction, over a portion of a contact stroke, the spring plunger, and thereafter the spring switching mechanism moving the spring plunger to its switched position.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
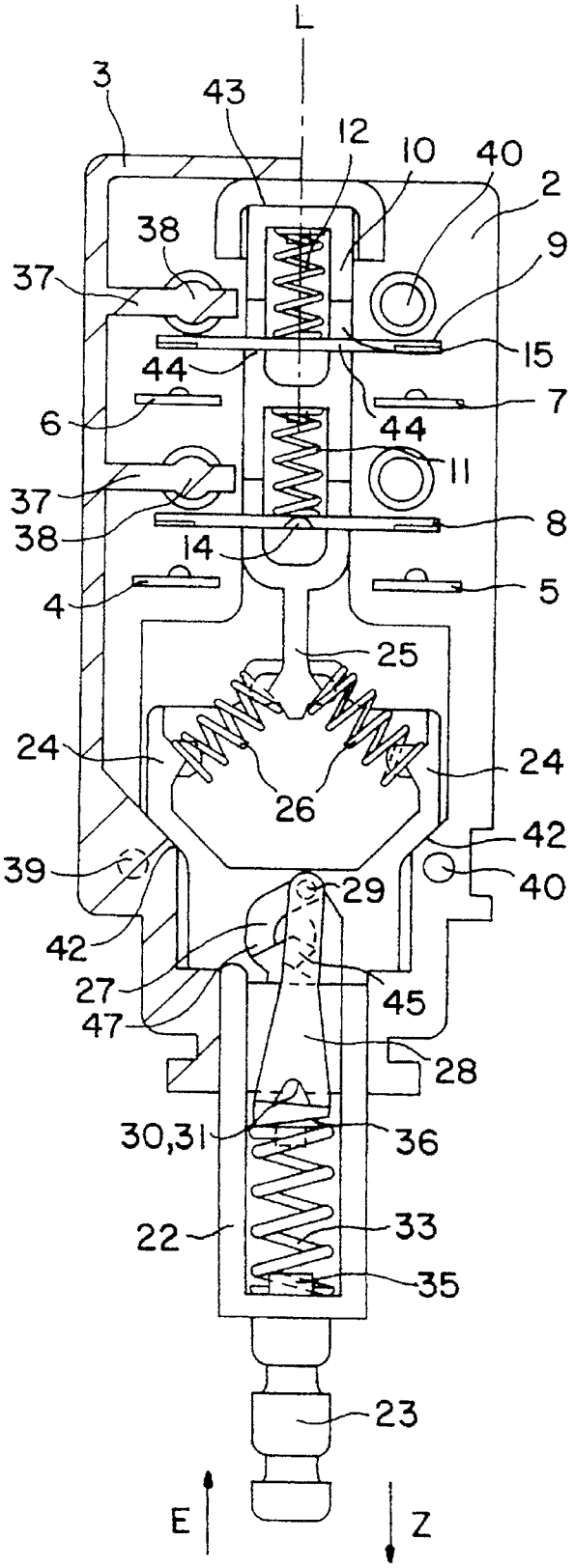
FIG. 1 PRIOR ART
FIG. 1 is a partially cutaway plan view of a prior art switch of the push button switch disclosed in German Patent Application P 43 01 192.6 in an "off" configuration.

Looking first at the switch of FIGS. 1–4, a housing 1 of a push button switch has a floor part 2 and a cover part 3. Two pairs of contacts 4, 5 and 6, 7 are attached to the floor part 2. Each contact pair 4, 5 and 6, 7 is directed toward a contact bridge 8, 9. This is a two pole switch.

A spring plunger 10 is mounted on the floor part 2 to be movable along its length axis L. The spring plunger 10 has two chambers in which pressure springs 11, 12 are mounted. The pressure springs 11, 12 are respectively supported at first ends by lugs 13 formed in the respective chambers and at the other ends by the contact bridges 8, 9. Each of the contact bridges 8 and 9 has for this purpose an indentation 14. The contact bridges 8, 9 extend at opposite ends, along their length axes, through holes 15 in the spring plunger 10, with these ends having play (room to move) therein.

An elastic spring tongue 16 is formed on the spring plunger 10 to cooperate with a protrusion 17 formed on the floor part 2 as is further described below. A first ramp (inclined surface) 18 of the protrusion 17 and a first ramp 19 of the tongue 16 form a first rubbing surface pair. A second ramp 20 of the protrusion 17 and a second ramp 21 of the tongue 16 form a second rubbing surface pair (compare FIGS. 2 and 4).

A switch actuator 22 is mounted on the floor part 2 to be movable along its length axis L, which corresponds to the length axis L of the housing 1 and forms a receiving plug 23 for engaging a push button switch (not shown in detail) outside of the housing 1.

The switch actuator 22 is formed to have an arm 24 on each side of the length axis L. Between each of the arms 24 and an extension 25 of the spring plunger 10 is arranged a pressure spring 26. In this manner, a spring switching mechanism is formed between the spring plunger 10 and the spring actuator 22.

A somewhat heart-shaped groove 27 is formed on the switch actuator 22 which serves to guide a follower lever 28. The follower lever 28 engages with a hexagonal lug 29 into the groove 27. A notch 30 is provided on the exterior of the floor part 2 in which a curved member 31 of the follower lever 28 engages.

The follower lever also has, outside of the floor part 2, a shoulder 32 which engages in an expanding spring 33 which also serves as a return spring 33 for the switch actuator 22. The return spring 33 lies in a chamber 24 of the switch actuator 22 and is held therein by means of a protrusion 35.

Figure 3:
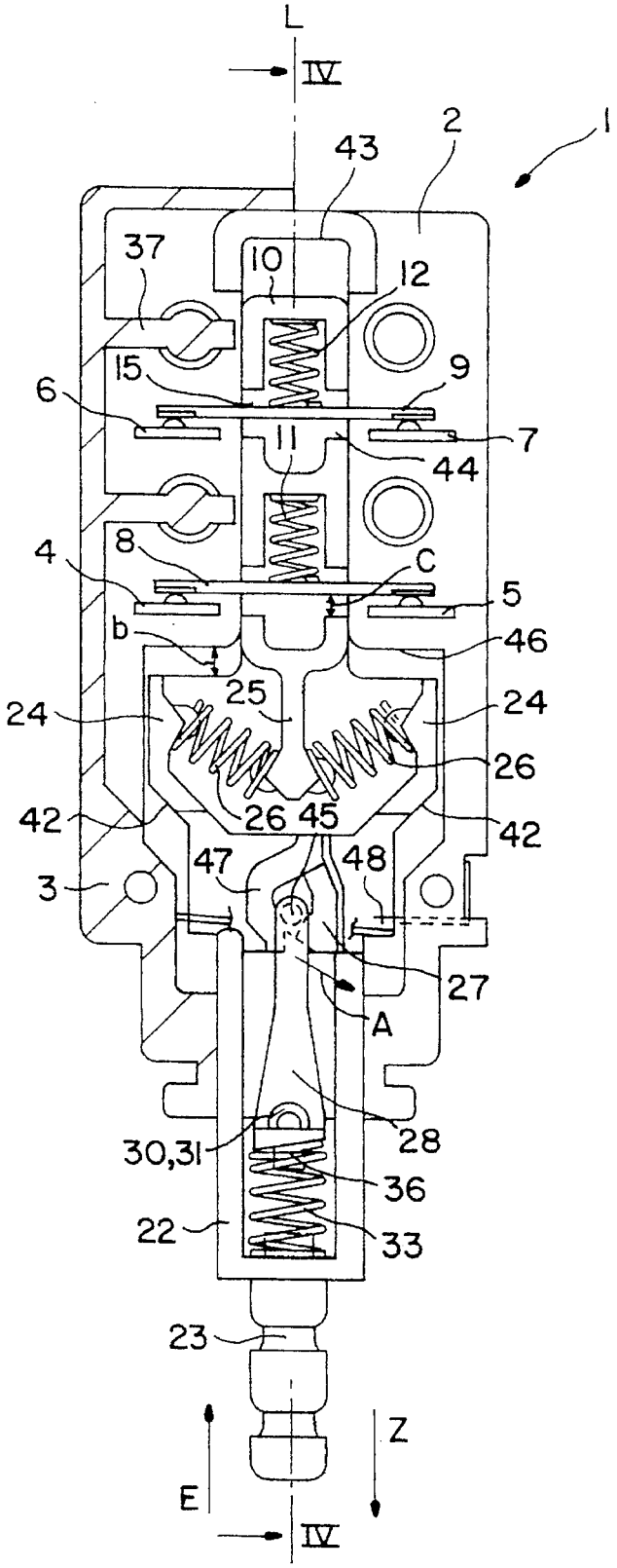
FIG. 3 PRIOR ART
FIG. 3 corresponds to the view of FIG. 1 but with the push button switch in an "on" configuration.

The follower lever 28 has on its end facing the return spring 33 an inclined surface 36 so that the follower lever 28 has a tendency, with its lug 29 in the groove 30, to swing in a preferred direction—in FIGS. 1, 3 towards the right—.

The described push button switch is mechanically uncomplicated to fabricate. In this regard, all parts can be moved into the floor part 2 from the same side (in FIG. 1 perpendicular to the drawing plane and in FIG. 2 from the right). Also, the described springs can be placed mechanically. The cover part 3 is applied from the same direction, which in FIGS. 1 and 3 is only represented at the left of the length axis L. Lugs 38 and 39 formed on ribs 37 engage in bores 40 of the floor part 2. A lower surrounding edge 41 of the floor part 2 forms a support for a circuit board, which is not shown in greater detail, with which the contact 4–7 can be coupled. The contacts 4–7 lie protected within the edge 41 so that no particles from outside can get to the contacts 4–7.

Figure 2:
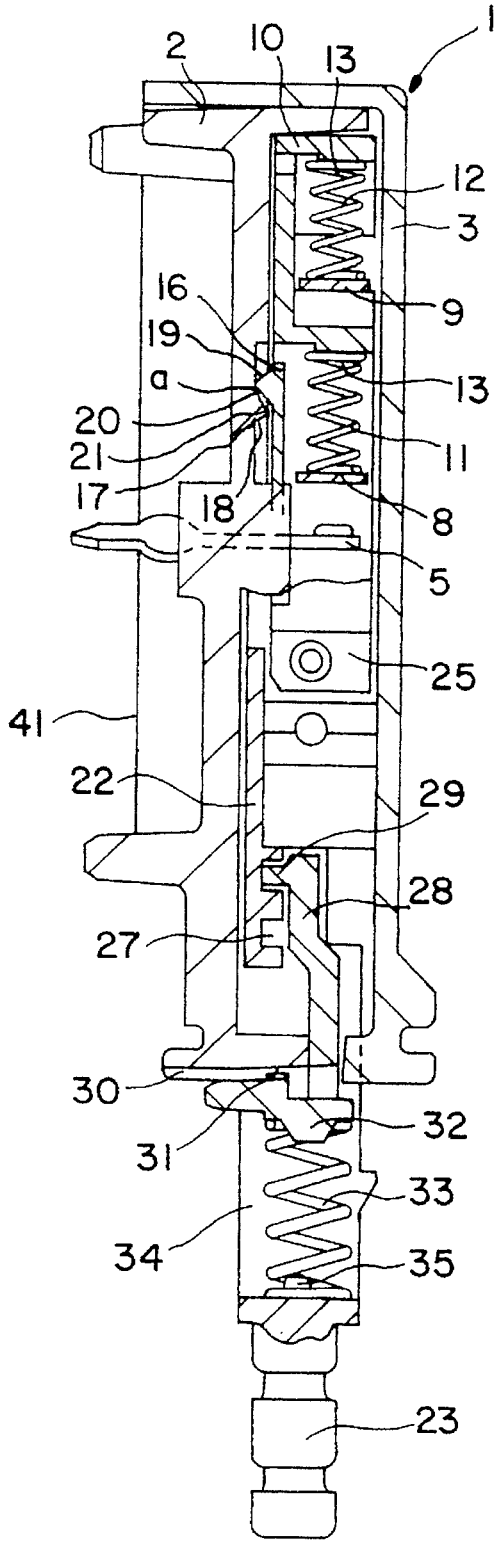
FIG. 2 PRIOR ART
FIG. 2 is a lengthwise cross sectional side view of the push button switch of FIG. 1.

The manner in which the described push button switch operates is as follows:

In the "off" configuration depicted in FIGS. 1 and 2 the switch actuator 22 is pressed against a stop 42 by the return spring 33. The pressure springs 26 are relatively relaxed and the spring plunger 10 is urged by the pressure springs 26 against a stop 43. The pressure springs 11, 12 press the contact bridges 8, 9 against edges 44 defining the holes 15. The contact bridges 8, 9 are thereby held away from the contacts 4, 5 and 6, 7.

If the switch is to be switched, then the switch actuator 22 is shoved in the pushed-in direction E. A guiding portion 47 of the groove 27 moves relative to the lug 29 of the follower lever 28. When the switch actuator 22 is moved, the pressure springs 26 are tensioned and are thereby caused to pass beyond their over-center point. Until this point is reached, the spring plunger 10 remains unmoved. After they have been urged beyond their over-center point, the pressure springs 26 cause a force in an opposite direction so that the spring plunger 10 is now accelerated in a direction opposite to the pushing-in direction E. After a first-free-movement stroke "a" (see FIG. 2), the second ramp 21 of the tongue 16 contacts the second ramp 20 of the protrusion 17 whereby these ramps now lie against one another as rubbing surfaces. These rubbing surfaces glide now, with a swinging of the tongue 16, on one another whereby movement of the spring plunger 10 is braked so that the contact bridges 8, 9, also braked, make contact with the contacts 4, 5 and 6, 7. In this manner a contact bouncing is avoided, or at least reduced. After the contact bridges 8, 9 have made contact with the contacts 4, 5 and 6, 7 the spring plunger 10 moves sufficiently further that the edges 44 are separated from the contact bridges 8, 9. Contact pressure is now guaranteed by the pressure springs 11 and 12.

Figure 4:
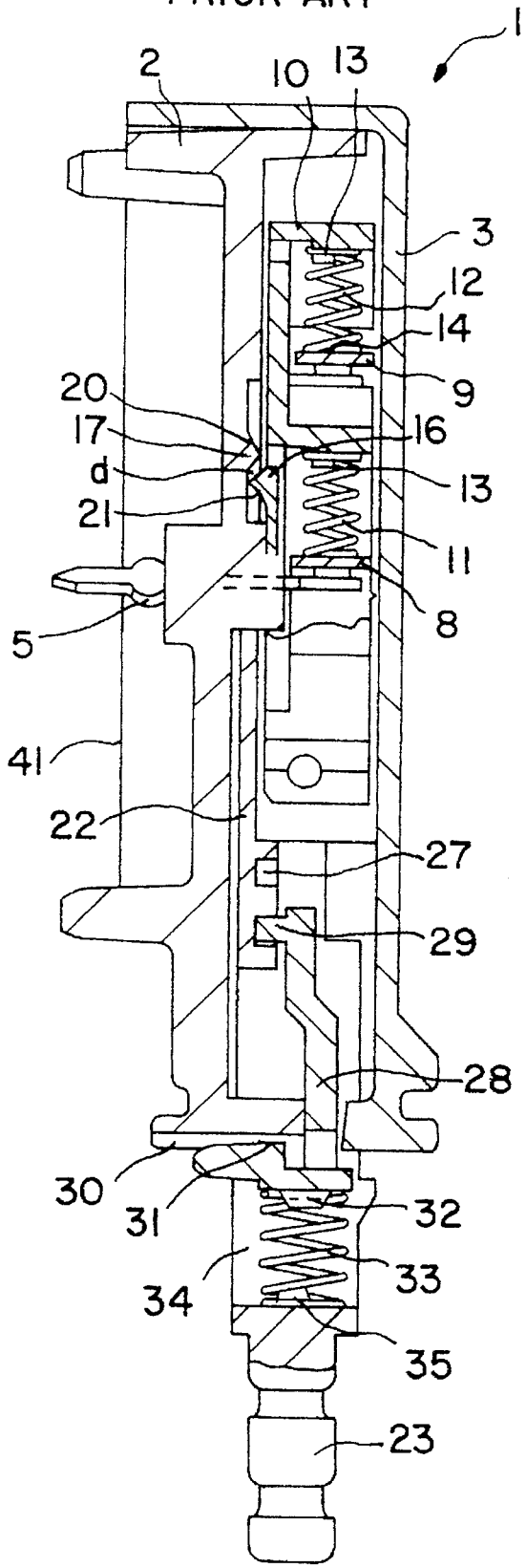
FIG. 4 PRIOR ART
FIG. 4 is a view corresponding to FIG. 2 but with the push button switch in an "on" configuration.

When the switch actuator 22 is released the lug 29 of the follower lever 28 goes into an engaging receiver 45 of the groove 27. The push button switch now is in the "on" position as is depicted in FIGS. 3 and 4.

If the switch actuator 22 is forcibly pulled in a pulling direction Z, so as to cause a switch manipulation which is not in accordance with the above described manner, then earlier latching devices, namely the groove 27 or the follower lever 28, would have been damaged. If in the described push button switch the switch actuator 22 is pulled in the pulling direction Z then the groove 27 carries the follower lever 28 in the pulling direction Z with it. This is possible because the follower lever 28, in the pulling direction Z, is not supported by the housing 1 rather it is supported via the return spring 33 of the switch actuator 22. The switch actuator 22 is also free for movement in the pulling direction Z. If, by such a manipulation, the switch actuator 22 moves sufficiently far that it contacts the stop 42, then the spring plunger 20 snaps into the "off" position by means of the pressure springs 26, as is described in more detail below.

To normally switch the push button switch from the "on" position into the "off" position the switch actuator 22 is manipulated in the pushing-in direction E. When this is done, edges forming the groove 27 shove the follower lever 28, via its lug 29, so that the lug 29 leaves the engaging receiver 45 in the direction of the arrow A (see FIG. 3) under the influence of the return spring 33 pressing against the inclined surface 36. After a short stroke b, which only must be sufficiently large that the lug 29 of the follower lever 28 can leave the engaging receiver 45, the switch actuator 22 contacts an edge 46 of the floor part 2. Until this point, the spring plunger 10 is stationary and is held by the pressure springs 26 in such a manner that its pressure springs 11, 12 maintain a necessary contact pressure between the contact bridges 8, 9 and the contacts 4, 5 and 6, 7.

The switch actuator 22 is then released, or manipulated, in an undesired manner to come out slowly. In both of these cases the switch actuator 22 is moved by the return spring 33 in the direction Z. When this is done, the pressure springs 26 are increasingly tensioned until they pass "over-center" or their "dead" positions. Even shortly before the over-center point is reached, the spring plunger 10 begins to move in the direction E. Because of the play, or clearance c between the edges 44 and the contact bridges 8, 9, the contact bridges 8, 9 are not yet engaged by the edges 44. There is a clearance d between the first ramp 18 of the protrusion 17 and the first ramp 19 of the tongue 16 in the "on" position which is smaller than the clearance c. The ramps 18, 19 which serve as rubbing surfaces therefore make contact with one another before the edges 44 engage the contact bridges 8, 9. The rubbing surface pairs of the ramps 18, 19 cause a delay in the snapping of the spring plunger 10 and the contact bridges 8, 9. Not until the rubbing surfaces of the ramps 18, 19 have glided along one another, with the spring loaded tongue 16 pivoting and the tensioned condition of the pressure springs 26 increasing, do the edges 44 of the spring plunger 10 contact the contact bridges 8, 9 and the ramps 18, 19 release from one another. The contact bridges 8, 9 thereby release from the contacts 4, 5 and 6, 7 with a jerk. The push button switch is then placed in the "off" position depicted in FIGS. 1 and 2.

Before the switching point is reached at which the contact bridges 8, 9 release from the contacts 4, 5 and 6, 7 with a jerk, a user can manipulate the switch actuator 22 without thereby, however, causing the contact bridges to lie against the contacts 4, 5 and 6, 7 with insufficient contact pressure. If the switch actuator 22, for example, is manipulated to an intermediate position in which the ramps 18, 19 already lie against one another and the pressure springs 26 are in the area of their over-center, or dead, point, then, because of this, there is still no danger of an increase in the contact resistance between the contact bridges 8, 9 and the contacts 4, 5 and 6, 7, and also no danger of a manipulated arc.

The ramp 19 which is parallel to the ramp 18 and the ramp 22 which is parallel to the ramp 20 have different inclined angles which correspond to the described manner of function. Usually, the ramps 18, 19 are more inclined than the ramps 20, 21 because the ramps 18, 19 serve to store a force for increasing the effects of the pressure springs 26 and the ramps 20, 21 are only supposed to cause a braking.

It is practical that the tongue 16 is released both in the "on" position and also in the "off" position—that is most of the time—and that during a switching action it is deflected. It is also possible to form the spring loaded tongue 16 on the floor part 2 and to provide the protrusion 17 on the spring plunger 10.

The rubbing surface pairs 18, 19; 20, 21 can however be so shaped that they are not inclined to the pushing direction E, rather that they lie parallel to the pushing direction E. In this case, a spring elastic element is not necessary. Surfaces which have heightened friction can then be formed of corresponding surface structures.

It is also possible to mount the follower lever 28 in the floor part 2. In this case, the follower lever 28 is then supported by an additional spring which allows it to be carried in a direction in the pulling direction Z. Contrary to the described arrangement, it is also possible to mount the follower lever 28 on the switch actuator 22 and then provide the groove 27 on the floor part 2. If the follower lever 28 does not release the switch actuator 22 upon its being pulled in the pulling direction Z, then instead of this the groove 27 can be so arranged that it, upon such a movement, follows the movement of the follower lever 28.

A further switch contact 48 is depicted in FIG. 3. This serves, for example, as an indicator of the respective switching positions of the push button switch.

Reference is made to the above described embodiment with regard to the FIGS. 5–8 embodiment. Accordingly, new parts and functions shown in FIGS. 5–8 are described as follows:

A cavity 49 is provided in an arm 24' of the switch actuator 22'. A first leg 50 of a switching rocker 51 engages in the cavity 49. A second leg 52 of the switching rocker 51 has a circularly-shaped opening 53 in which a lug 54 formed on an extension 25' of the spring plunger 10' engages.

Between the legs 50, 52, of the switching rocker 51, there is a mounting cavity 55 in the switching rocker into which a pin 56 affixed to the housing 1 extends with play, or clearance. The pin 56 is formed on the cover part 3 (see FIG. 2).

Figure 5:
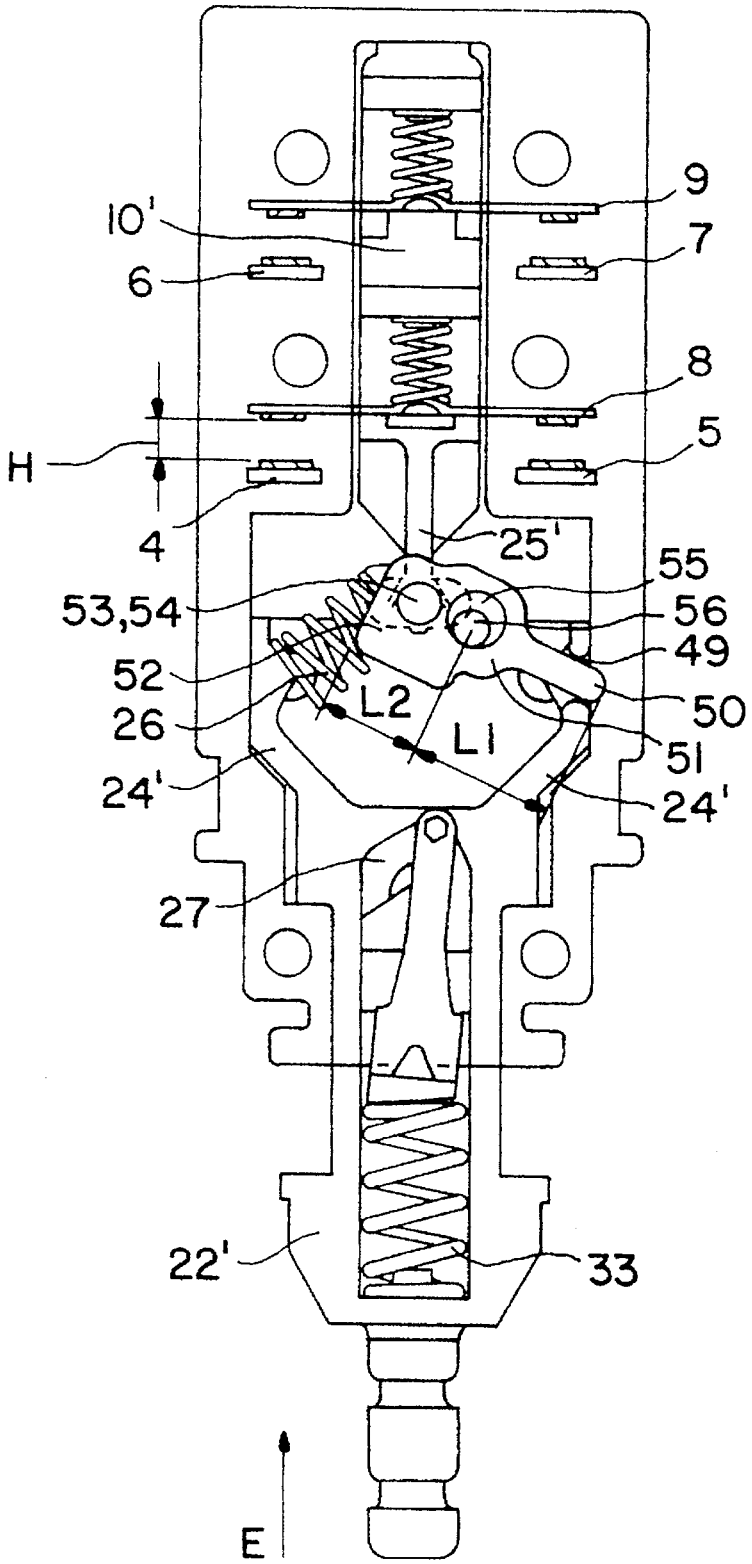
FIG. 5 is a plan view of a push button switch of this invention having a switching rocker, during a first stage of a "turning on" operation (moving from a turned "off" to a turned "on" configuration)
Figure 6:
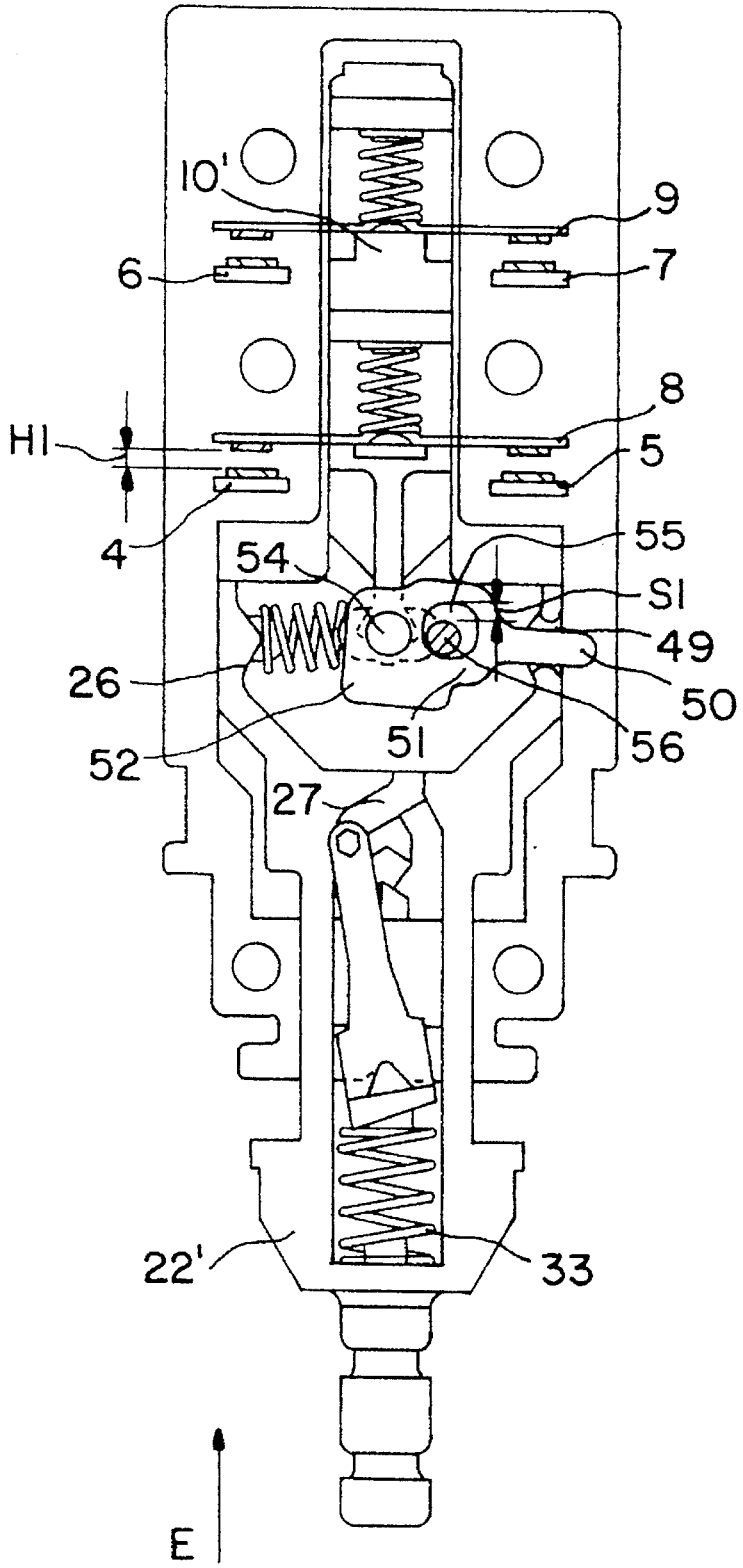
FIG. 6 is a view similar to FIG. 5 at a second stage in the "turning on" operation.

Beginning with the "off" position shown in FIG. 5, a "turning on" operation takes place as follows:

If the switch actuator 22 is pushed in the pushing direction E, then its arm 24' carries the switching rocker 51, by its leg 50, with it. The switching rocker 51 thereby rotates about the pin 56 and forcibly carries the spring plunger 10 opposite to the pushing direction E along a partial path of a contact stroke H (see FIG. 5). Because of the lengths L1 and L2 of the legs 50 and 52, an intermediate position (see FIG. 6) is then reached in which, between the contact bridge 8 and the contacts 4, 5 and correspondingly between the other contact bridge 9 and its contacts 6, 7, a rest clearance H1 is present. In this intermediate position, the contacts of the contact bridges 8, 9 and the contacts 4, 5 and 6, 7 are sufficiently separated from one another that no arc can develop between them. In this intermediate position there is free play, or clearance, S1 in the mounting cavity 55 so that under the influence of the now-tensioned pressure springs 26 (only one pressure spring is shown in each of FIGS. 5–8) the spring plunger 10 can be snapped toward the switch actuator 22, which is then locked, in the above described manner, in the "on" position depicted in FIG. 7 in which the contacts are closed. Shortly thereafter, the already-described free clearance c between the contact bridges 8, 9 and the edges 44 adjust itself. This procedure cannot be influenced by a user. Because the rest clearance H1 is definite and is shorter than the contact stroke H the contacting speed of the contact bridges 8, 9 on the contacts 4, 5 and 6, 7, when compared with operation of the push button switch of FIGS. 1–4, is significantly reduced.

A contact bounce time is also relatively small so that only very small arcs and thereby only a small amount of erosion of the contact material takes place. Because of the rest clearance H1 an exact switching, or snapping point, which the user cannot influence, is guaranteed.

Figure 7:
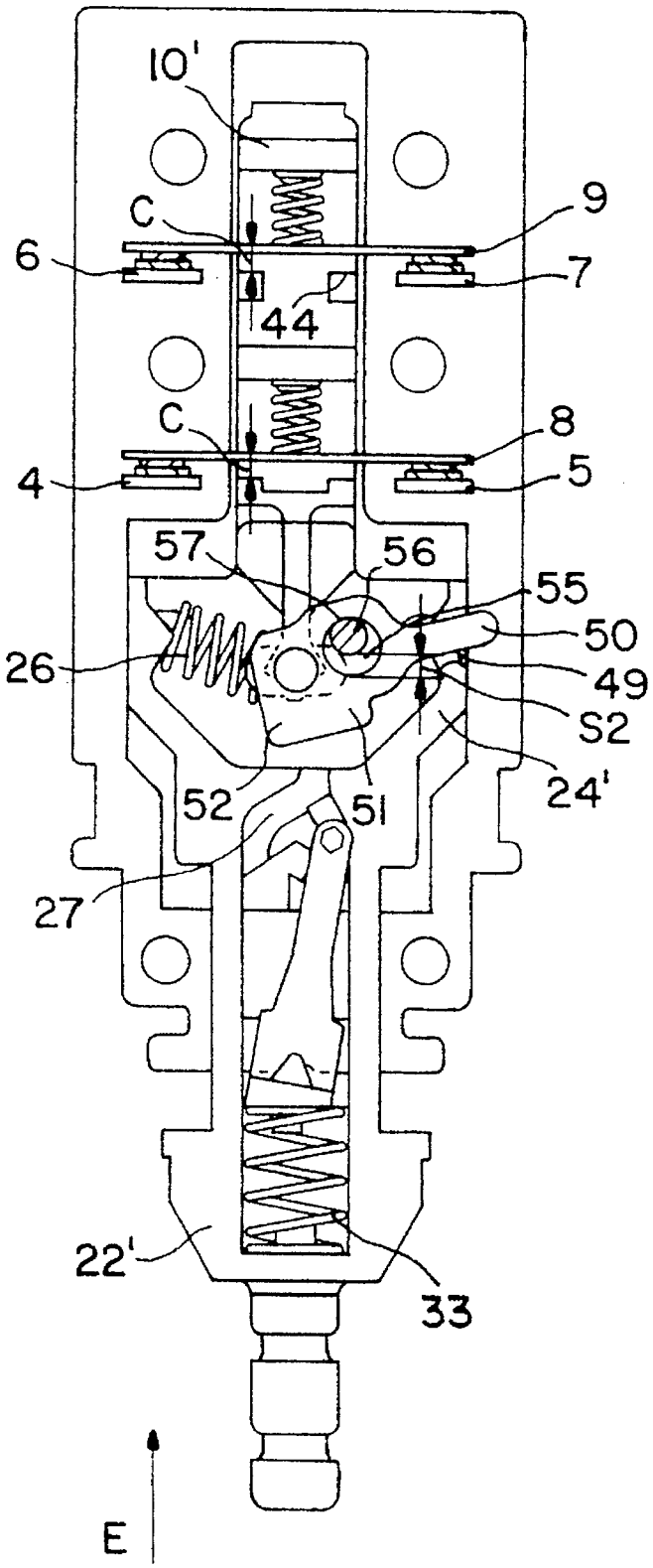
FIG. 7 is a plan view of the push button switch of this invention with the switching rocker at a first stage when the switch is being turned off (going from a turned "on" to a turned "off" configuration)
Figure 8:
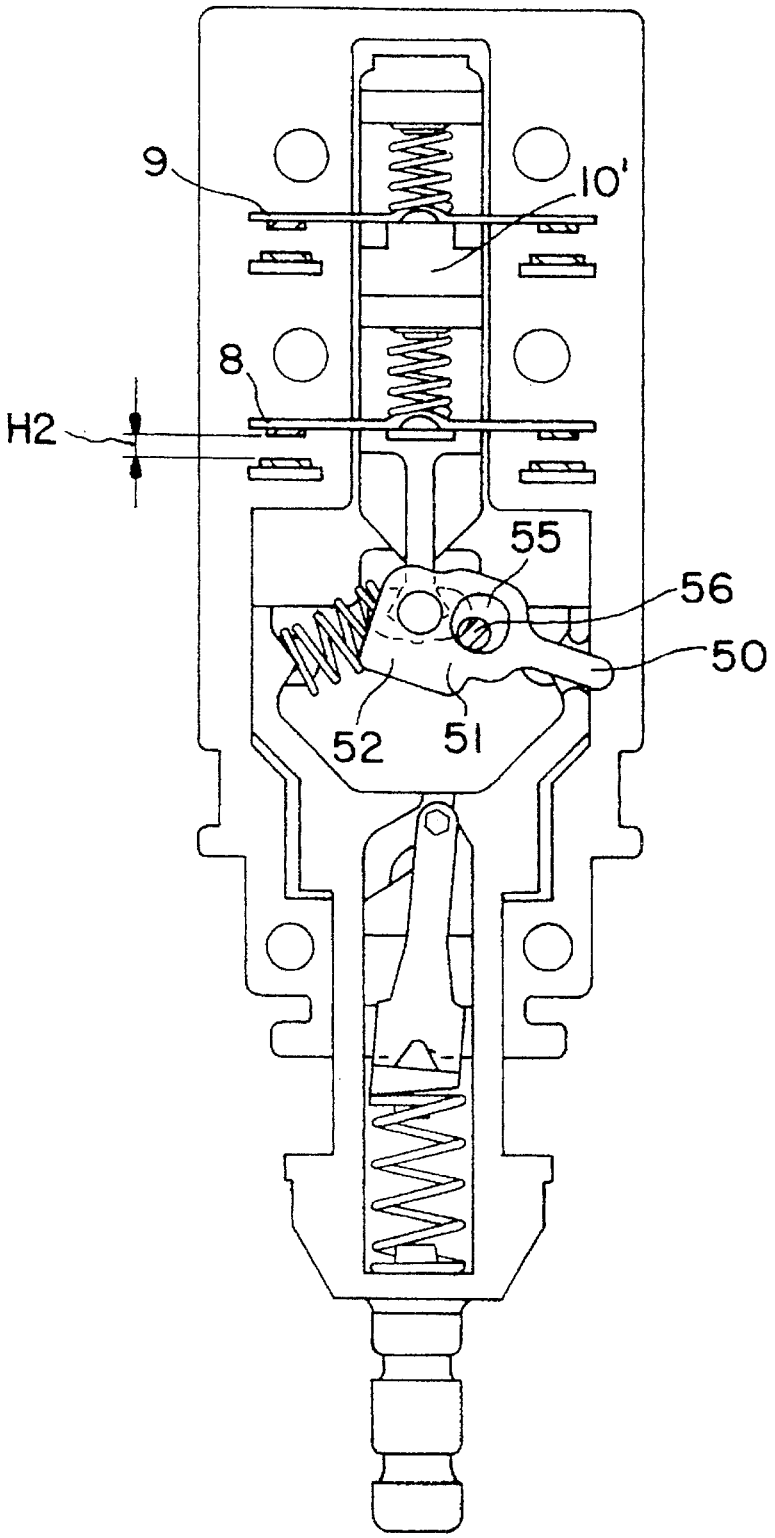
FIG. 8 is a view similar to FIG. 7 at second stage in the "turning off" operation.

If a user begins a turning off procedure starting from the "on" position represented in FIG. 7, for which the user presses the switch actuator 22 in the pushing direction, then the switch actuator 22 will be moved by the return spring 33 in a direction opposite the pushing direction E after release of the locking linkage, or device. The cavity 49 of its arm 24 thereby carries the switching rocker 51 by its leg 50 with it. The switching rocker 51 thereby pivots about a mounting mechanism 57, which comprises the pin 56 and edges defining the mounting cavity 55. Regarding the mounting mechanism 57, there is a play, or clearance, S2 between an edge forming the mounting cavity 55 and the pin 56. Pivoting of the switching rocker 51 causes its leg 52 to move the spring plunger 10 so that the clearance c (see FIG. 3) becomes smaller whereby the edges 44 get closer to the contact bridges 8, 9. Under operation of the pressure springs 26 the spring plunger 10 then springs about so that the play S2 disappears and the contact bridges 8, 9 release from the contacts 4, 5 and 6, 7. In this intermediate position (see FIG. 8) a clearance H2 is created. Thereafter the spring plunger 10 moves linearly to the position depicted in FIG. 5. During this described "turning off" operation, smaller electrical arcs between the contacts result from the momentary continuance of the clearance H2 then with the push button switch of FIGS. 1–4. Even if the contacts should stick in the position depicted in FIG. 7 an opening of these contacts is guaranteed by means of the switching rocker 5 as is described above.

Thus, it is achieved that the speed with which the movable contacts impact with the fixed contacts is reduced. This results in a reduced bounce time and electrical arcs, which, in turn, reduces contact erosion. Thus, even when switching greater power at higher switching speeds, smaller contacts can be used.

A further benefit is achieved in that, upon normal manipulation of the switch, an exact switching point is maintained because it results from a snapping of the spring plunger by the switching spring mechanism at the end of the partial gliding path movement of the spring plunger. Contrary to known switching operations, the switching, or snapping, point is thereby not influenced by static friction. A user cannot influence the snapping point.

Regarding the "turning off" operation, the push button switch of this invention provides the benefits that only small electrical arcs are created, and also that, when the contacts stick dependable openings still generally result.

While the invention has been particularly shown and described with reference to a preferred embodiment, it will be understood by those of ordinary skill in the art that various changes in form and detail may be made therein without departing from the spirit and scope of the invention.

The invention claimed is:

1. A push button switch having a housing, fixed contacts affixed to the housing, a movable contact bridge, a spring plunger for moving through a contact stroke to move the contact bridge into and out of contact with said fixed contacts, a manually-actuated switch actuator, a spring switching mechanism that transmits force between the spring plunger and the manually-manipulated switch actuator, a locking linkage attached to the switch actuator for alternately holding the switch actuator in a switched-on position and a switched-off position when the switch actuator is pushed, wherein:

a switching rocker is provided between the switch actuator and the spring plunger, with the switching rocker engaging the switch actuator on one side and the spring plunger on the other side, said switching rocker being mounted on the housing by a mounting means for causing the switching rocker, at the beginning of a switching operation of the switch actuator, to forcibly carry with it the spring plunger, in a switching direction, through a portion of the contact stroke, and wherein the spring switching mechanism moves the spring plunger without active enforcement by said switching rocker through the rest of its switching stroke to its switched position after this portion of the contact stroke.

2. A push button switch as in claim 1 wherein the mounting means comprises edges defining a mounting cavity of the switching rocker and a pin affixed to the housing, there being a substantial clearance between the pin and the edges defining the mounting cavity which is present during a turning on operation and a turning off operation.

3. A push button switch as in claim 1 wherein the switching rocker has a first leg which engages in a cavity of the switch actuator and can be thereby pivoted by the switch actuator about the mounting means.

4. A push button switch as in claim 3 wherein the switching rocker has a second leg which pivotally engages the spring plunger, for linearly moving the spring plunger.

* * * * *